United States Patent [19]

van der Heide

[11] Patent Number: 4,972,046

[45] Date of Patent: Nov. 20, 1990

[54] CONNECTION MEANS FOR ELECTRICAL INFORMATION CONTAINING SIGNALS AND METHOD FOR MANUFACTURING THE SAME

[75] Inventor: Henri J. van der Heide, Hilversum, Netherlands

[73] Assignee: Nederlands Omroeproduktie Bedrijf N.V., Hilversum, Netherlands

[21] Appl. No.: 414,930

[22] Filed: Sep. 29, 1989

Related U.S. Application Data

[63] Continuation-in-part of Ser. No. 227,757, Aug. 3, 1988, abandoned.

[30] Foreign Application Priority Data

Sep. 4, 1987 [NL] Netherlands ..... 8702102
Jun. 16, 1988 [NL] Netherlands ..... 8801535

[51] Int. Cl.[5] ..... H01B 1/00; H01B 13/00

[52] U.S. Cl. ..... 174/126.1; 148/108; 264/24; 338/214; 338/334

[58] Field of Search ..... 174/126.1; 338/66, 214, 338/333, 334; 423/447.1, 447.2, 460; 148/108; 264/24, 105

[56] References Cited

U.S. PATENT DOCUMENTS

| | | | |
|---|---|---|---|
| 330,071 | 12/1885 | Tichenor | 174/126.1 |
| 2,584,441 | 2/1952 | Fredendall | 264/24 |
| 2,697,028 | 12/1954 | Baker et al. | 264/29.6 |
| 3,666,847 | 5/1972 | Bailey | 264/105 X |
| 3,676,535 | 7/1972 | Juel | 264/105 X |
| 3,814,699 | 6/1974 | Baldieri et al. | 252/397 |
| 4,102,331 | 7/1978 | Grayzel et al. | 128/640 |
| 4,537,850 | 8/1985 | Smeiman | 148/108 X |
| 4,639,929 | 1/1987 | Bernard et al. | 373/120 |
| 4,855,091 | 8/1989 | Geus et al. | 264/105 X |

FOREIGN PATENT DOCUMENTS

| | | | |
|---|---|---|---|
| 60982 | 8/1985 | Japan | 264/105 |

*Primary Examiner*—Morris H. Nimmo
*Attorney, Agent, or Firm*—Lorusso and Loud

[57] ABSTRACT

A connecting element is provided comprising an electrical conductor and a conductive path of arranged carbon along the connecting element's entire connecting length. The conductive path can either be formed as an integral part of the electrical conductor or as a separate element which works in cooperation with the electrical conductor. The carbon is arranged in that the nuclear magnetic resonance of substantially all of the carbon atoms of the conductive path has a determined orientation. The carbon is arranged by way of the connecting element being passed through a magnetic dc field which orients the nuclear magnetic resonance of the carbon atoms with relation to that field.

15 Claims, 1 Drawing Sheet

CONNECTION MEANS FOR ELECTRICAL INFORMATION CONTAINING SIGNALS AND METHOD FOR MANUFACTURING THE SAME

RELATED U.S. APPLICATION DATA

This is a Continuation-In-Part application of U.S. patent application Ser. No. 07/227,757 filed Aug. 3, 1988 now abandoned.

FIELD OF THE INVENTION

The present invention relates to a connecting element for electrical, information containing signals, comprising an electrical conductor including a conductive path of arranged carbon.

BACKGROUND OF THE INVENTION

Such connecting elements are used in various applications. One such application is connecting elements which are formed for use as connecting lines for audio equipment including, for example, connections for compact disc players, loudspeaker lines, and internal signal lines in audio apparatus. Although the technical qualities for audio apparatus with respect to signal noise ratio, distortion and other characteristics have been greatly improved through the advent, for example, of compact disc players, known connecting elements continue to be responsible for a considerable degree of sound quality denigration.

Known connecting elements typically consist of metal conductors surrounded by at least one layer of insulative material. Due to the naturally occurring disorder of the nuclear magnetic resonance of the individual atoms of these metal conductors, however, they are not capable of faithfully transferring all of the information contained in the electrical signals.

Connecting elements using these traditional metallic conductors, therefore, cannot accurately transfer the structural information in the signals traveling through them such as the location of sound sources in stereo audio sources.

It is therefore an object of the present invention to provide a connecting element which faithfully transfers electrical, information containing signals.

It is another object of the present invention to provide a connecting element which preserves structural information in stereo audio signals.

SUMMARY OF THE INVENTION

The problems of the prior art are greatly alleviated by the connecting element of the present invention which comprises a conductor and a conductive path of carbon having an ordered nuclear magnetic resonance along its entire connecting length. While it is possible that the conductor be either partially or totally formed of arranged carbon for providing the conductive path as an integral part of the conductor, so to may the conductor path of arranged carbon be provided as a separate element which operates in conjunction with the conductor.

Regardless of the manner in which the conductive path of arranged carbon is provided, in accordance with the present invention a connecting element is obtained which is capable of transferring the complete signal passing through it without loss of information experienced with known connecting elements. The connecting element of the present invention can be used in different areas such as for example, connecting line in audio or video equipment. In particular, when used for sound reproduction, the connecting element of the present invention retains the information contained in the original sound image to a far greater extent than known connecting elements. This allows for an extremely faithful reproduction of the original sound image.

Another application of the connecting element according to the present invention is as connecting line in measurement and control apparatus. In that field, as well, signals can be measured and transferred by way of the present invention without any loss of information . Additionally, the connecting element of the present invention can be used in all internal signal connections as well.

DETAILED DESCRIPTION OF PREFERRED EMBODIMENTS

At the outset the invention is described in its broadest overall aspects with a more detailed description following. In its broadest aspects, the present invention is a connecting element comprising an electrical conductor and a conductive path of arranged carbon extending along its entire connecting length. The present invention's conductive path of arranged carbon can either be formed as an integral part of the electrical conductor or as a separate element working in cooperation with the electrical conductor. It is to be understood with respect to this description that "arranged" carbon signifies carbon that has an ordered nuclear magnetic resonance.

Figure 1:
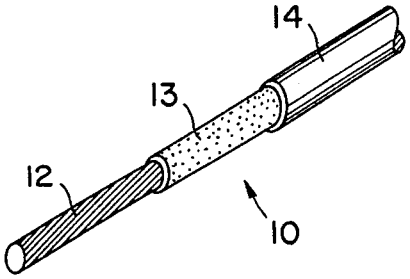
FIG. 1 is a perspective view of one end of one embodiment of the connecting element of the present invention.

As depicted in FIG. 1, in one embodiment of the present invention there is provided a connecting element 10 comprising an electrical conductor 12 which is surrounded by a conductive path 13 of arranged carbon. An insulative material 14 covers both the electrical conductor 12 and the conductive path 13. The conductive path 13 is formed of carbon which has been arranged by way of having been passed through a magnetic dc field.

It is generally known that the nuclear magnetic resonance of each individual atom of a naturally occurring electrical conductor such as carbon will have a random orientation. In accordance with the present invention, however, by passing the connecting element 10 through a magnetic dc field, the nuclear magnetic resonance of all of the carbon atoms of the conductive path 13 are given a determined orientation with respect to the magnetic field.

To this end, the connecting element 10 is led, for example, through an annular coil being supplied with a direct current. To achieve the desired result of sufficiently arranged carbon of the conductive path 13 the field strength should be at least 4000 Amperes per meter. Preferably, the field strength will be greater than 6000 Amperes per meter.

By so doing, a connecting means will be obtained having a conductive path formed at least partially of arranged carbon which will guarantee the transfer of all information contained in the original electrical signal. Experiments with an audio system partially equipped with a connecting element in accordance with the present invention have shown that a complete faithful reproduction of the input electrical signal is obtained while the original spatial impression of the recording space is maintained.

Figure 2:
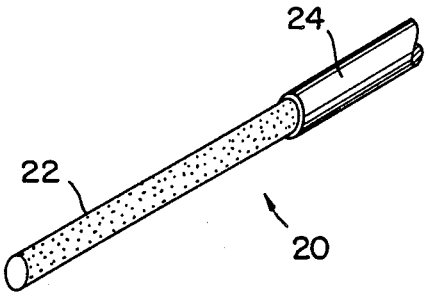
FIG. 2 is a perspective view of one end of another embodiment of the connecting element of the present invention.

In another embodiment of the present invention as shown in FIG. 2, there is provided a connecting element 20 wherein an electrical conductor 22 itself is formed at least partially of arranged carbon. In this embodiment of the present invention the conductive path as discussed above is formed as an integral part of the electrical conductor 22 to provide improved transfer of electrical information containing signals. As with the previously discussed embodiment, the connecting element 20 is also surrounded by an insulative material 24.

Figure 3:
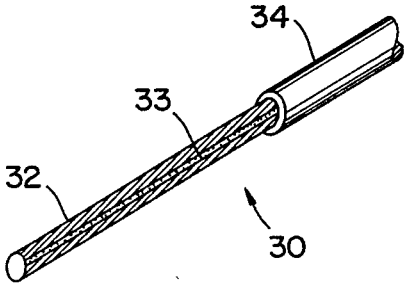
FIG. 3 is a perspective view of one end of yet another embodiment of the connecting element of the present invention.

In FIG. 3 there is shown a connecting element 30 comprising an electrical conductor 32 which can be formed of any material such as is commonly known in the art. One such suitable material for the electrical conductor 32 is copper. The electrical conductor 32, however, is further provided with a trough like region within which is disposed a conductive path 33 of arranged carbon. The arrangement of the carbon of the conductive path 33 of the connecting element 30 is achieved in the same way as the arrangement of the carbon of the connecting element 10 depicted in FIG. 1. That is, the connecting element 30 is passed through a magnetic dc field to give the carbon atoms a nuclear magnetic resonance in relation to the magnetic field. Again, there is an insulative material 34 covering the connecting element 30.

While FIG. 3 depicts the conductive path 33 as being parallel to the longitudinal axis of the connecting element 30, it is also possible for the conductive path 33 to travel around the electrical conductor 32 in a spiral fashion. Any means by which the conductive path 33 extends the entire connecting length of the connecting element 30 is intended to be embraced by the concept of the present invention.

It should be noted that the term connecting element is also intended to denote other types of electrical components in addition to those specifically discussed herein. An example of such other electrical components would include carbon resistors. In general, therefore, it should be understood that the invention is not to be restricted to the above described embodiments which merely illustrative of several which utilize the concept of the present invention. The invention, therefore, is to be defined not by the preceding description but by the claims that follow.

What is claimed is:

1. A connecting element for communicating electrical, information containing signals, comprising an electrical conductor formed at least partially of magnetically arranged carbon along its whole connecting length.

2. The connecting element as set forth in claim 1, wherein said electrical conductor is formed entirely of magnetically arranged carbon along its whole connecting length.

3. The connecting element as set forth in claim 1, wherein said connecting element is formed for use as connecting line in audio and/or video apparatus.

4. The connecting element as set forth in claim 1, wherein said connecting element is formed for use as connecting line in measurement and control apparatus.

5. A connecting element for communicating electrical, information containing signals, comprising an electrical conductor and a conductive path of magnetically arranged carbon along its whole connecting length.

6. The connecting element as set forth in claim 5, wherein said electrical conductor defines a channel extending the entire connecting length of the connecting element, said conductive path of magnetically arranged carbon being disposed within said channel.

7. The connecting element as set forth in claim 6, wherein said channel is parallel to the longitudinal axis of the connecting element.

8. The connecting element as set forth in claim 6, wherein said channel travels spirally around the periphery of said electrical conductor.

9. The connecting element as set forth in claim 5, wherein said conductive path surrounds said electrical conductor.

10. The connecting element as set forth in claim 5, wherein said connecting element is formed for use as connecting line in audio and/or video apparatus.

11. The connecting element as set forth in claim 5, wherein said connecting element is formed for use as connecting line in measurement and control apparatus.

12. A method for manufacturing a connecting element for communicating electrical, information containing signals, comprising;

forming an electrical conductor having a conductive path of carbon along its entire connecting length; and arranging the carbon of the conductive path by means of a magnetic dc field.

13. The method as set forth in claim 12 wherein the carbon of said conductive path of the electrical conductor is arranged by the connecting element being passed through an annular coil being supplied with direct current.

14. The method as set forth in claim 13 wherein the magnetic field has a strength of field of at least 4000 Amperes per meter.

15. The method as set forth in claim 14 wherein the magnetic field has a strength of field of at least 6000 Amperes per meter.

* * * * *